US008901403B2

(12) United States Patent
Barnett

(10) Patent No.: US 8,901,403 B2
(45) Date of Patent: Dec. 2, 2014

(54) ADJUSTABLE MAGNETIC SUPPORT FOR GUITAR OR OTHER INSTRUMENT

(71) Applicant: Kristopher Charles Barnett, Atlanta, GA (US)

(72) Inventor: Kristopher Charles Barnett, Atlanta, GA (US)

(73) Assignee: Kristopher C. Barnett, Royal Palm Beach, FL (US)

( * ) Notice: Subject to any disclaimer, the term of this patent is extended or adjusted under 35 U.S.C. 154(b) by 0 days.

(21) Appl. No.: 13/868,691

(22) Filed: Apr. 23, 2013

(65) Prior Publication Data

US 2013/0305897 A1 Nov. 21, 2013

Related U.S. Application Data

(63) Continuation-in-part of application No. 13/276,317, filed on Oct. 18, 2011, now Pat. No. 8,455,744.

(51) Int. Cl.
*G10D 3/00* (2006.01)
*G10G 5/00* (2006.01)

(52) U.S. Cl.
CPC ..... *G10G 5/005* (2013.01)
USPC ..... 84/327

(58) Field of Classification Search
CPC ..... G10G 5/005
USPC ..... 84/327
See application file for complete search history.

(56) References Cited

U.S. PATENT DOCUMENTS 1,261,841 A * 4/1918 Mortensen ..... 84/327
1,945,162 A * 1/1934 Rasmussen ..... 84/327
4,592,265 A * 6/1986 Steinberger ..... 84/327
4,693,161 A * 9/1987 Uhrig ..... 84/327
4,779,509 A * 10/1988 Weir ..... 84/421
4,966,062 A * 10/1990 Driggers et al. ..... 84/327
5,388,492 A * 2/1995 Olson ..... 84/327
5,739,445 A * 4/1998 Terry et al. ..... 84/329
D410,669 S * 6/1999 Hamre ..... D17/20
6,252,150 B1 * 6/2001 Johnson ..... 84/327
6,422,522 B1 * 7/2002 Woollen ..... 248/166
6,576,823 B1 * 6/2003 Wise, Jr. ..... 84/327
7,205,468 B1 * 4/2007 Johnson ..... 84/327
7,312,388 B2 * 12/2007 Oskorep ..... 84/322
7,638,698 B1 * 12/2009 Bellissimo ..... 84/379
7,678,979 B1 * 3/2010 Roop ..... 84/309
7,732,689 B1 * 6/2010 Jiang et al. ..... 84/327
7,900,881 B2 * 3/2011 Campagna ..... 248/153
8,362,345 B1 * 1/2013 Rice ..... 84/327
8,440,894 B2 * 5/2013 Amland ..... 84/327

(Continued)

*Primary Examiner* — Robert W Horn

(57) ABSTRACT

An improved adjustable stringed instrument apparatus, hereafter known as 'support', 'instrument support' or 'guitar support', that supports the instrument in playing position while the user is in the sitting position. The support attaches to the instrument using magnets and rests on the user's leg. It utilizes a leg rest connected via an adjustable support with a magnet housing at each end of the leg rest. This instrument support has several unique benefits over suction cup-type supports such as secure and reliable attachment to the instrument, non-marring attachment components, and the ability to be attached to a variety of imperfect surfaces and shapes. In addition, magnets have the unique ability to allow location of the support repeatedly at the exact desired location when it is secured to the instrument. Three discrete mechanisms on the support allow for vertical, horizontal, and angular adjustments of the instrument. The support's design allows it to be easily attached, removed, adjusted, collapsed, and stored. Several additional embodiments of the invention are also described and illustrated.

22 Claims, 13 Drawing Sheets

(56) References Cited

U.S. PATENT DOCUMENTS

| | | | | |
|---|---|---|---|---|
| 8,455,744 | B2 * | 6/2013 | Barnett | 84/327 |
| 8,530,733 | B2 * | 9/2013 | Bibb | 84/327 |
| 2004/0182984 | A1 * | 9/2004 | Sandkuhl | 248/443 |
| 2008/0196572 | A1 * | 8/2008 | Navarro | 84/327 |
| 2010/0024622 | A1 * | 2/2010 | Kim | 84/291 |
| 2010/0307316 | A1 * | 12/2010 | Jones et al. | 84/421 |
| 2011/0219935 | A1 * | 9/2011 | Amland | 84/327 |
| 2013/0032020 | A1 * | 2/2013 | Applegate et al. | 84/379 |
| 2013/0047817 | A1 * | 2/2013 | Kaynor | 84/379 |
| 2013/0081530 | A1 * | 4/2013 | Risolia et al. | 84/322 |
| 2013/0092009 | A1 * | 4/2013 | Barnett | 84/327 |
| 2013/0228060 | A1 * | 9/2013 | Linden et al. | 84/267 |
| 2013/0305897 | A1 * | 11/2013 | Barnett | 84/327 |

* cited by examiner

ADJUSTABLE MAGNETIC SUPPORT FOR GUITAR OR OTHER INSTRUMENT

BACKGROUND AND BRIEF SUMMARY OF THE INVENTION

There have been several designs for an apparatus that supports a guitar or similar stringed instrument while in a seated playing position (U.S. Pat. Nos. 7,732,689; 7,205,468; 6,252,150; 6,005,175; 4,966,062 and 3,979,993). The current invention implements novel and improved mechanisms for both adjusting the instrument's position vis-à-vis the player and the means for attaching the support to the instrument.

An object of this invention is to provide a novel instrument support that can be securely attached to any acoustic guitar or like instrument regardless of the instrument's finished surface. Previous designs implemented plastic or rubber suction cups that do not adhere well to curved, recessed, worn, damaged, porous, delicate, oily, or otherwise imperfect surfaces (U.S. Pat. Nos. 7,205,468; 6,252,150; 6,005,175; 4,966,062). It is also well established that these attachment means can be deleterious to various finishes commonly found on stringed instruments such as lacquer and shellac. Furthermore, such contacting means require periodic replacement as their usefulness as an attachment mechanism decreases in time due to wear and/or material breakdown.

Other designs use an apparatus that supports the instrument from underneath but is not directly or securely attached to it (U.S. Pat. Nos. 7,732,689 and 3,979,993). The Support cushion (U.S. Pat. No. 3,979,993) is limited in both its adjustability and ease of storage, while the Foldable support (U.S. Pat. No. 7,732,689) only allows for vertical adjustment and not horizontal or angular adjustments. Further disadvantages of existing designs have been noted by Jiang & Yan (U.S. Pat. No. 7,732,689).

The current support alleviates the above mentioned issues by implementing magnets as the attachment means to the instrument and three discrete mechanisms for vertical, horizontal, and angular adjustments. Magnets or magnetic material attached to the support member attract magnets or magnetic material installed on or in the body of the instrument. Magnetic attraction is the mechanism by which the instrument support attaches to the instrument.

Substituting magnetic material (e.g. rare earth magnets) for suction cups allows the support to be smaller, more versatile, and have greater adjustability than previous suction cup-type supports. The size of the support is decreased and is thus more portable due to the relatively small size of the magnets needed for attaching the support to the instrument. The reduced footprint also increases versatility as the support can be attached to instruments that are too thin for suction-type supports. The strength of the magnets also improves adjustability as the magnets can withstand adjustments that would cause other attachment mechanisms to fail.

Magnets are implemented not only as an attachment means but also as a locating mechanism for the support. Magnets have the unique property of attracting other magnets or ferrous material and will "find" the magnets installed on the guitar ensuring consistent and proper placement of the support each time it is used. Setup time is further decreased because the adjustment settings do not need to be changed when collapsing and storing the support.

Three discrete mechanisms allow for vertical, horizontal, and angular adjustments. Vertical adjustments are achieved by adjusting the length of the flexible leg support member. The pivoting magnet housing allows horizontal adjustments while in playing position. These adjustments are made by moving the support longitudinally along the underside of the instrument. This adjustment is possible because the rotating magnet housing will conform to any contour on the underside of the instrument. The adjustable rigid support member allows angular adjustment of the instrument while in playing position. These adjustments are achieved by loosening the securing member and adjusting the overall length of the support.

These objects are achieved by a novel support that comprises a flexible leg support member connected to both an adjustable rigid support member with hinged pivoting magnet housing at one end and a second magnetic member at the other. The instrument support is held in place on the instrument by magnetic attraction or similar fields of a force.

An alternative embodiment of this invention substitutes a curved rigid leg support member for a flexible leg support member. A second adjustable rigid support member is implemented for greater versatility and adjustability. Furthermore, the leg support member rotates on an axis and rests flat on the player's leg to further increase comfort for the player. A toothed clutch mechanism holds the rotating leg support member in the desired position and adjustments are made by disengaging the toothed clutch and rotating the leg support member about an axis. Several mechanisms can be implemented to ensure proper engagement and disengagement of the clutch such as a spring or screw mechanism.

This summary is not intended to exhaust all possible embodiments of the invention, nor is it intended to determine the scope of the claimed matter. It is a general explanation of the benefits, intended uses, and possible embodiments of the invention contained herein.

DETAILED DESCRIPTION OF DRAWINGS

It has been illustrated that an instrument support that can be attached to the instrument using magnets or magnetic material and is adjustable by three discrete mechanisms may be provided in accordance with this invention. These figures represent several possible embodiments of the invention and are not meant as an exhaustive representation of all possible designs.

Figure 1:
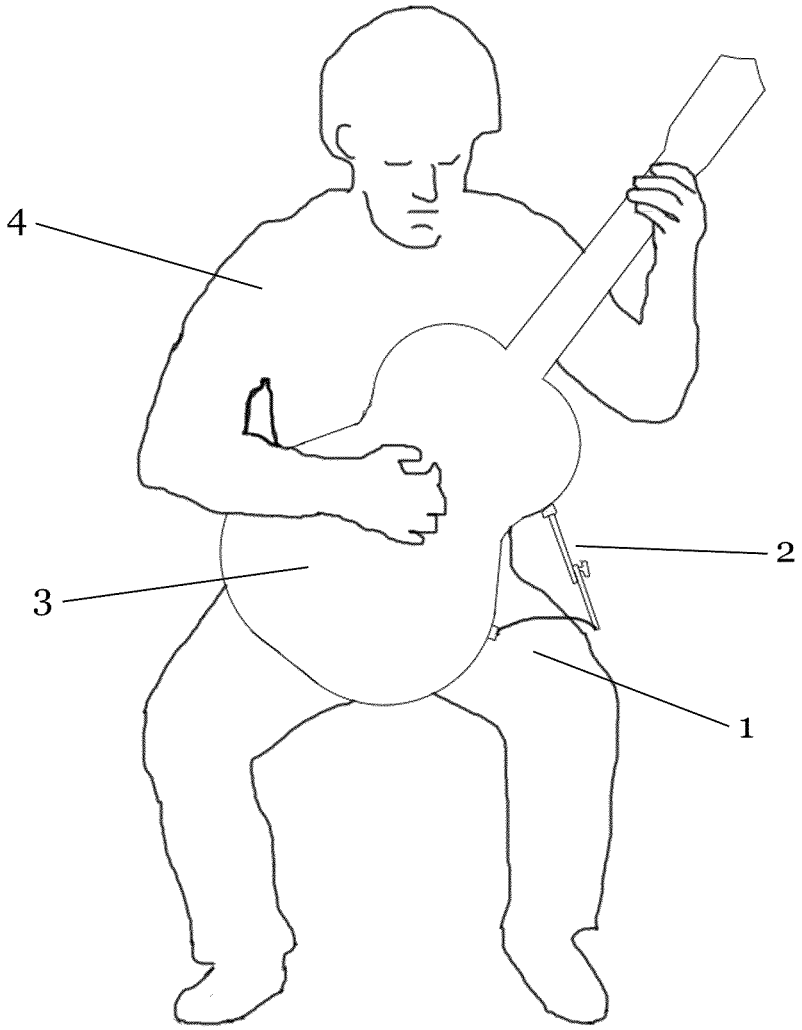
FIG. 1 of the drawings is a perspective view of an instrumentalist using an instrument support in accordance with this invention.

FIG. 1 of the drawings illustrates an instrumentalist (4) in sitting position playing an instrument (3) with an instrument support (2) in accordance with this invention. A support (2) is attached to an instrument (3) and rests on a player's leg (1). A support (2) will be described in further detail with reference to FIG. 2.

Figure 2:
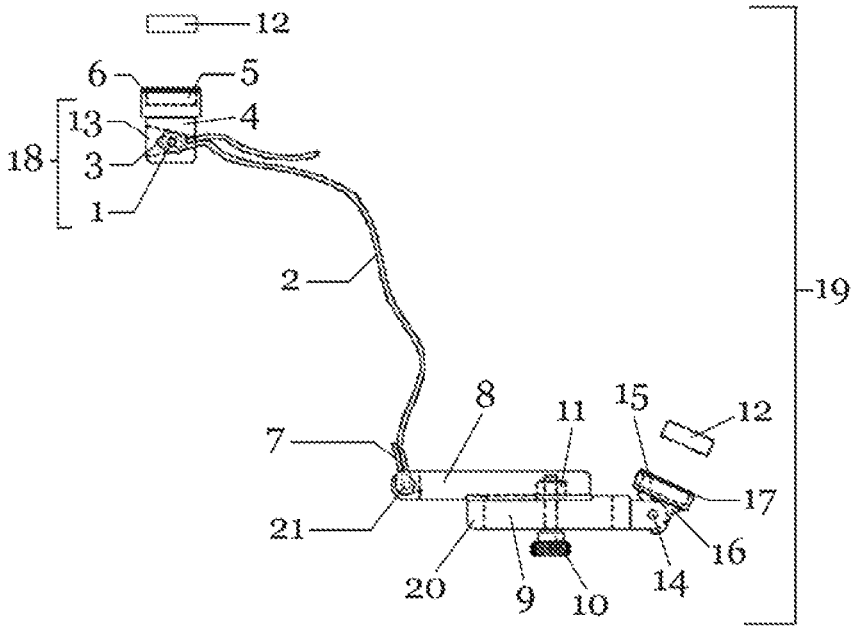
FIG. 2 of the drawings is a perspective detailed view of an instrument support in accordance with this invention.
Figure 3:
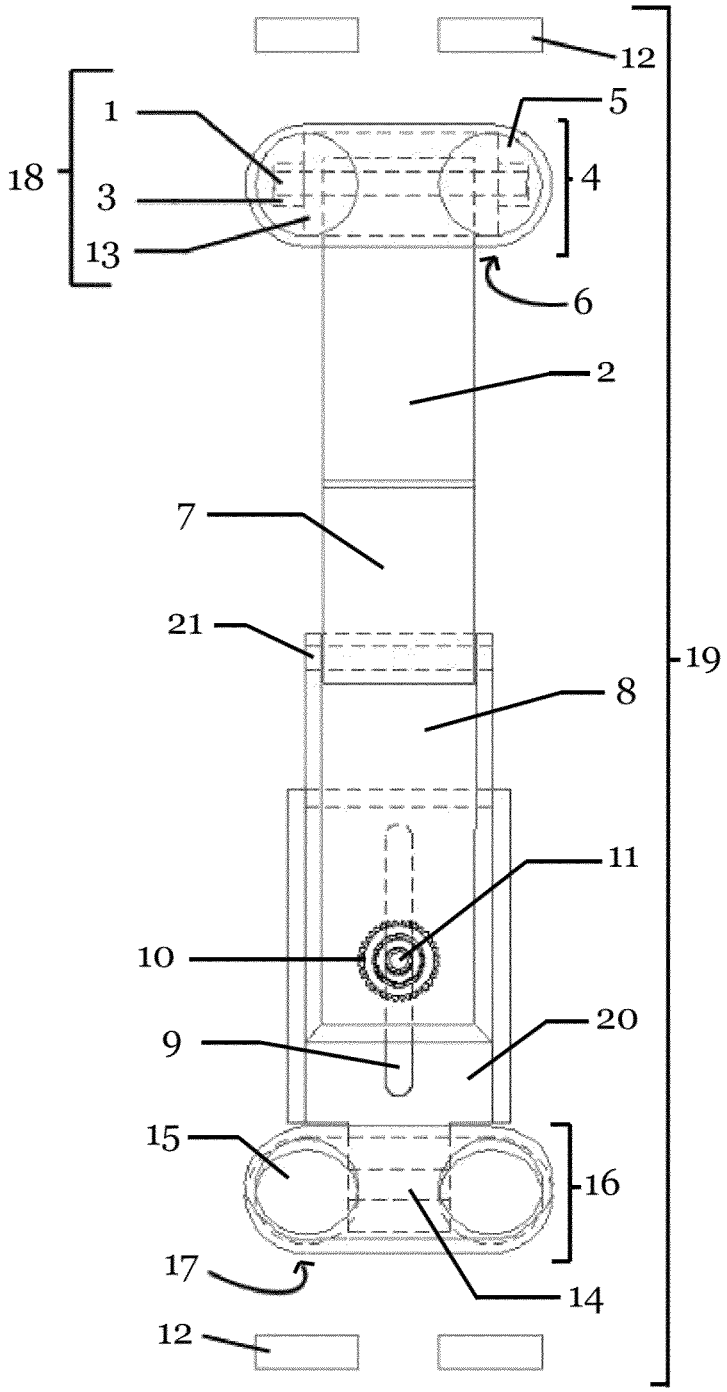
FIG. 3 of the drawings is a perspective view of an instrument support from above as it lays flat.

FIG. 2 of the drawings is a lateral, semi-transparent view of a support. A support (19) is comprised of a flexible, slip-resistant leg support member (2) attached to a first magnetic member (4) on one end and a first rigid support member (8) on the opposing end. The flexibility of a leg support member (2) allows a support to be easily collapsed and stored and also allows maximum comfort for a user. A housing (4) comprises a soft, non-corrosive, and slip-resistant material (6) that separates a housing (4) from an instrument. A material (6) is a protective barrier between an instrument and a housing (4) and also ensures continuous proper placement of a support (19) while attached to an instrument. A housing (4) also contains a magnet(s) or magnetic material (5) that attract other magnet(s) or magnetic material (12) that are installed in or on the side of an instrument. A housing (4) is also comprised of an adjustment mechanism (18) that allows the length of a leg support member (2) to be adjusted. Adjusting the length of a leg support member (2) alters the vertical positioning of an instrument while attached to a support (19). An adjustment mechanism (18) is comprised of a machined void (13), a channel (3), and a securing pin or similar member (1) that is free to move along the length of a channel (3) when a mechanism is not in a secured state. A leg support member (2) is inserted between a securing pin (1) and magnet housing (4). A leg support member (2) then envelopes a securing pin (1), and exits a housing (4). An adjustment mechanism (18) secures a leg support member (2) when force is applied to a securing pin (1), thereby moving it along a channel (3) toward the majority portion of an instrument support (19) until a leg support member (2) is fixed between a securing pin (1) and a magnet housing (4). A leg support member (2) is unsecured using force to move a securing pin (1) along a channel (3) away from the majority portion of a support (19). A leg support member (2) passes through a slot or similar component (21) in a first rigid support member (8) and is affixed back on to itself (7). It is obvious that many options for securing a leg support member (2) to a first rigid support (8) exists. A second rigid support member (20) is machined to form a channel (9) allowing the overall total length of a first rigid support (8) and second rigid support (20) to be increased or decreased. Adjusting the overall length of a first rigid support (8) and second rigid support (20) will alter the angle of the instrument in relation to an assumed horizontal plane. The overall length of a first rigid support (8) and second rigid support (20) is secured with a threaded male member (10) that is inserted into a threaded female member (11) in a first rigid support (8). It is obvious that these members can be reversed so that a threaded male member is attached to a first rigid support (8) and is accepted by a female member on a second rigid support (20). A hinge or similar mechanism (14) connects a second magnetic member (16) to a second rigid support member (20). A second magnetic member (16) comprises a soft, non-corrosive, and slip-resistant material (17) that separates a housing (16) from the instrument. The material (17) is a protective barrier between the instrument and a housing (16) and also ensures continuous proper placement of a support (19) while attached to the instrument. A housing (16) also contains a magnet(s) or magnetic material (15) that attract other magnet(s) or magnetic material (12) that are installed in or on the side of the instrument. A hinge (14) allows a second magnetic member (16) to adopt any curve on the side of the instrument thus allowing unlimited horizontal positioning of a support on the instrument FIG. 3 of the drawings is a semi-transparent view of an instrument support member viewed from above as it lays flat. All components, members, mechanisms, and features visible in FIG. 2 (1-20) are duly illustrated in this view. A first magnetic member (4) is attached to a leg support member (2), which is attached to a first rigid support member (8), which is attached to a second rigid support member (20), which is hinged to a second magnetic member (16). A machined channel (9) in a second rigid support (20) is clearly visible from this perspective.

Figure 4:
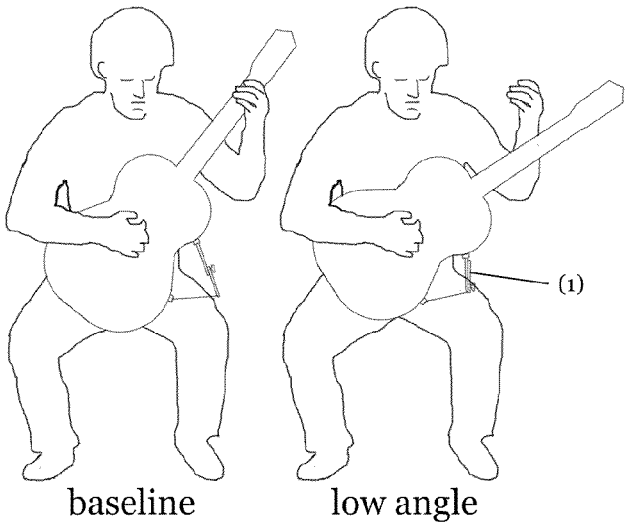
FIG. 4 of the drawings illustrates use of an angular adjustment mechanism of a support in accordance with this invention.

FIG. 4 of the drawings illustrates use of an angular adjustment mechanism of a support. Adjusting the length of a first and second support member (1) will alter the angular position of an instrument in relation to an assumed horizontal plane.

Figure 5:
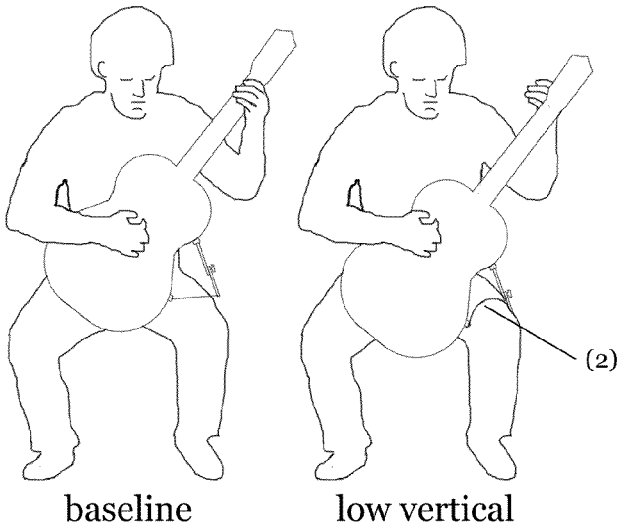
FIG. 5 of the drawings illustrates use of a vertical adjustment mechanism of a support in accordance with this invention.

FIG. 5 of the drawings illustrates use of a vertical adjustment mechanism of a support. Adjusting the length of a leg support member (2) will alter the vertical position of an instrument vis-à-vis a user.

Figure 6:
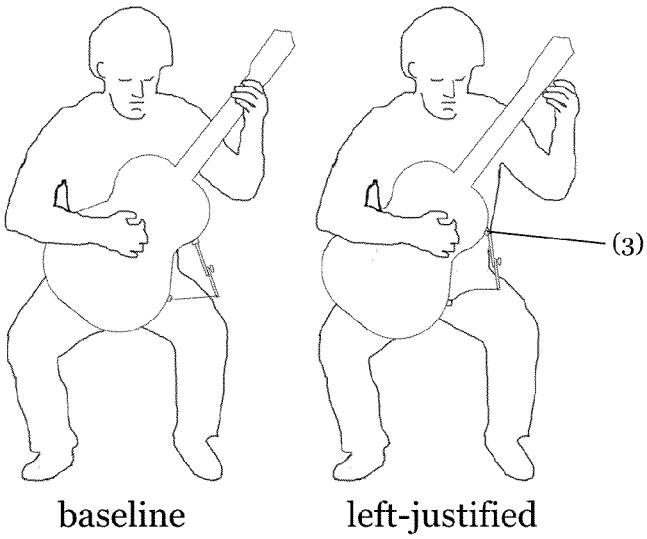
FIG. 6 of the drawings illustrates use of a horizontal adjustment mechanism of a support in accordance with this invention.

FIG. 6 of drawings illustrates use of a horizontal adjustment mechanism of a support. Adjusting the longitudinal position of a support on the underside of a guitar will alter the horizontal position of an instrument vis-à-vis a user. A pivoting attachment member (3) allows for this adjustment.

Figure 7:
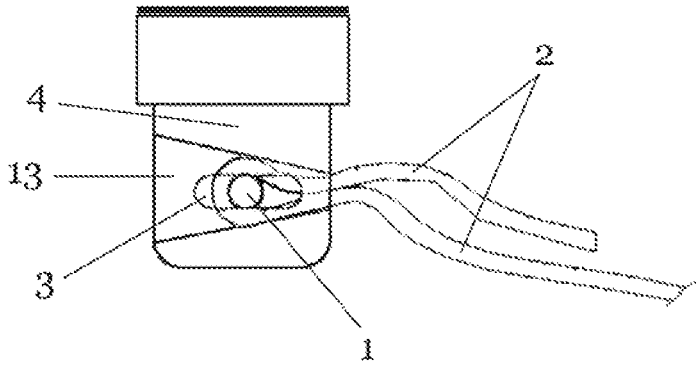
FIG. 7 of the drawings is a perspective detailed view of a first magnetic member and a leg support member adjustment mechanism in accordance with this invention.

FIG. 7 of the drawings illustrates a detailed semi-transparent view of a first magnetic member (4). A leg support member (2) is secured in a machined void (13) when a securing pin or similar member (1) is forced along the length of a channel (3) toward the majority portion of a support and is fixed between a magnet housing (4) and a securing member (1).

Figure 8:
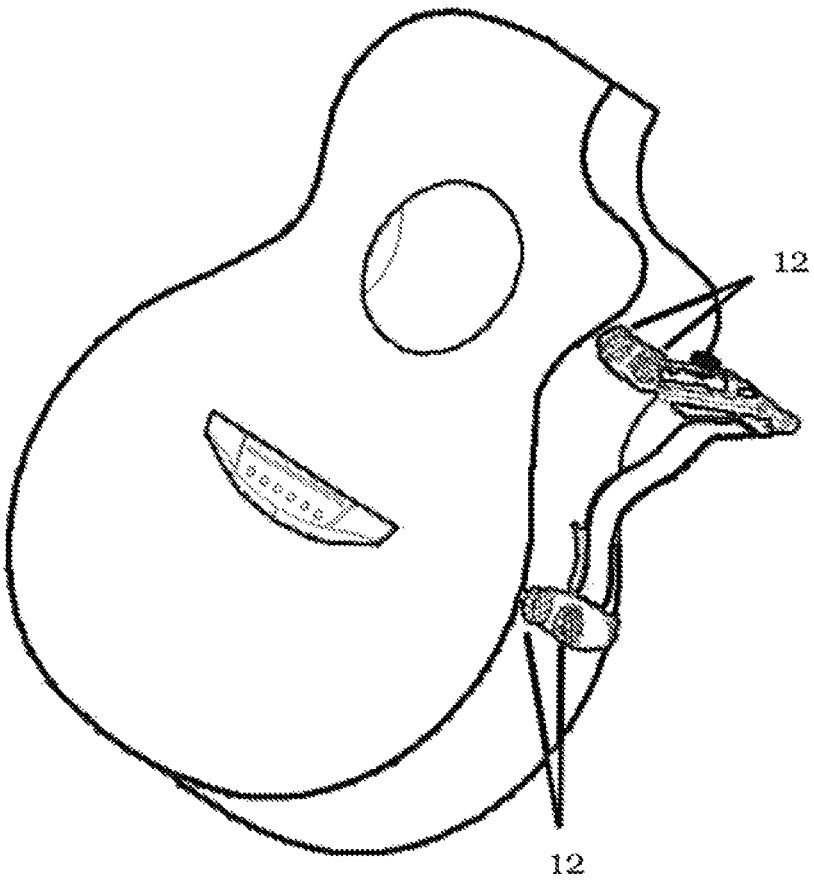
FIG. 8 of the drawings is a perspective view of an instrument support attached to a stringed instrument in accordance with this invention.

FIG. 8 of the drawings is a semi-transparent perspective view of an instrument support attached to an instrument. An internal magnet(s) or magnetic material (12) affixed on or in an instrument is visible.

Figure 9:
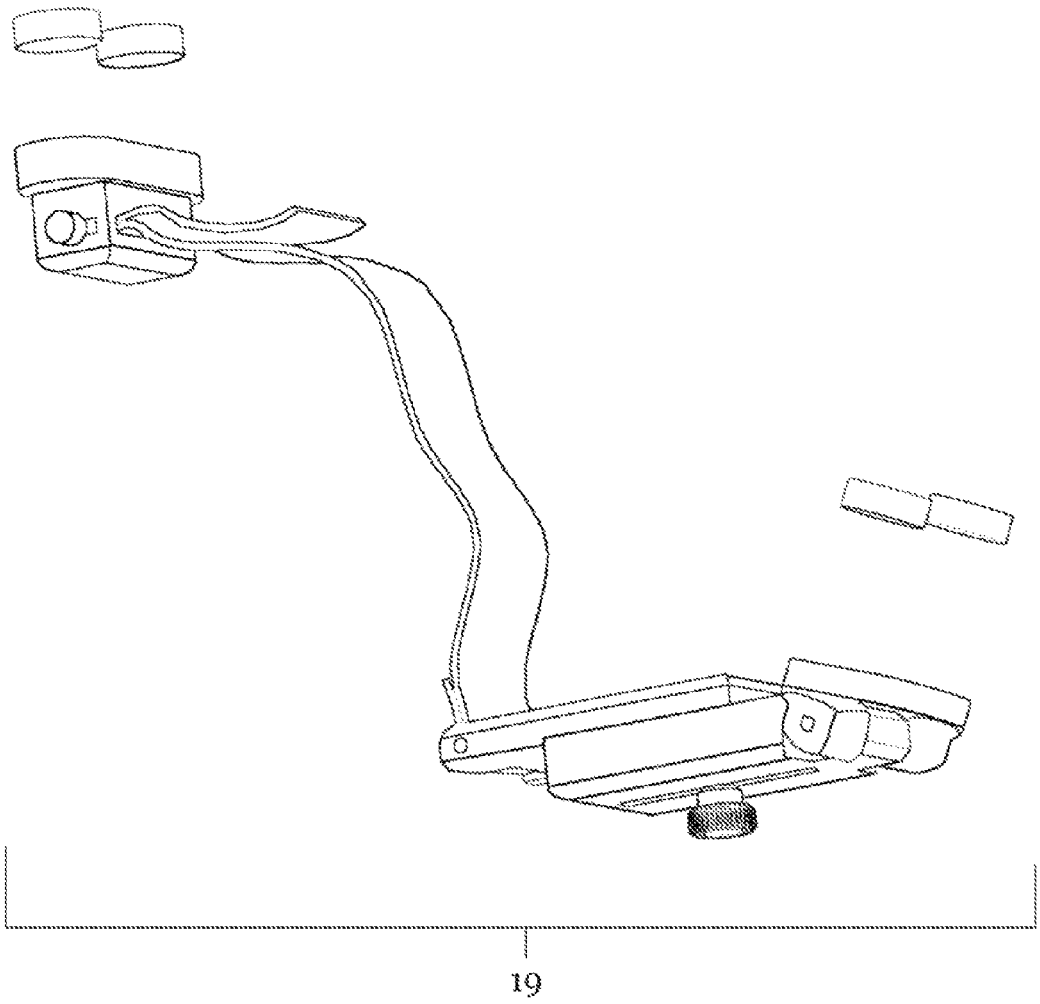
FIG. 9 of the drawings is a 3 dimensional view of an instrument support in accordance with this invention.

FIG. 9 of the drawings is a 3-dimensional view of a guitar support (19). An internal magnet(s) or magnetic material is not visible.

Figure 10:
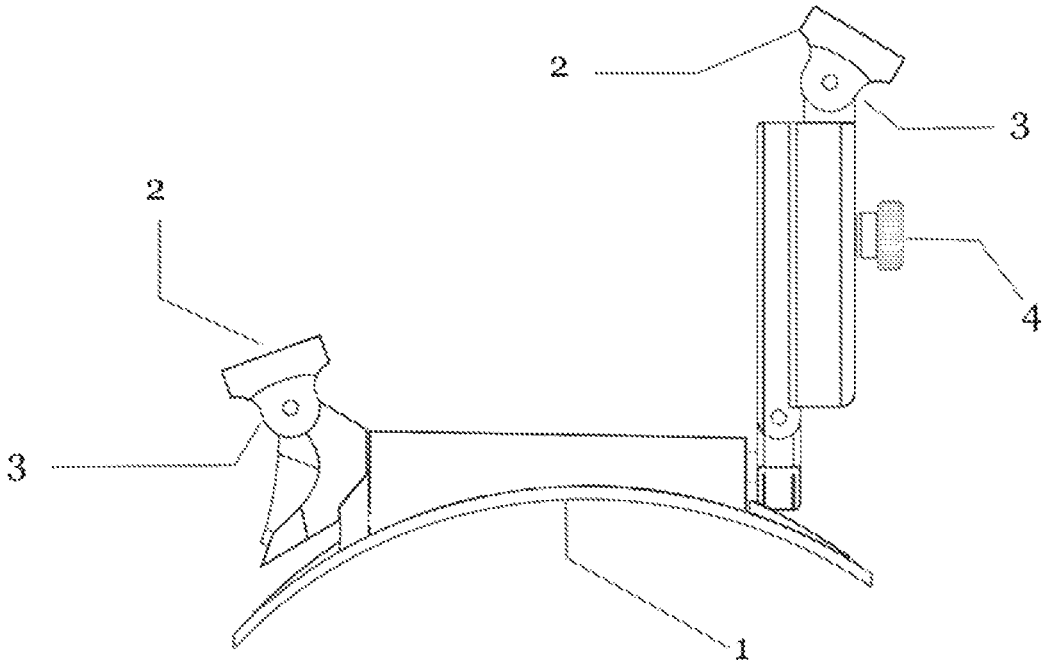
FIG. 10 of the drawings is a perspective embodiment of a support illustrating a rigid leg support member in place of a flexible leg support member in accordance with this invention.

FIG. 10 of the drawings is a lateral view of a support implementing a rigid leg support member (1) in place of a flexible leg support member illustrated in FIG. 2 (2). Several components and mechanisms for this embodiment are identical to FIG. 2 (5, 6, 8, 9, 10, 11, 12, 14, 15, 16, 17, 20) but are not illustrated here for simplicity. Key features such as a magnet housing (2), magnet housing hinge (3), and securing member for an adjustable rigid support (4) are illustrated as references.

Figure 11:
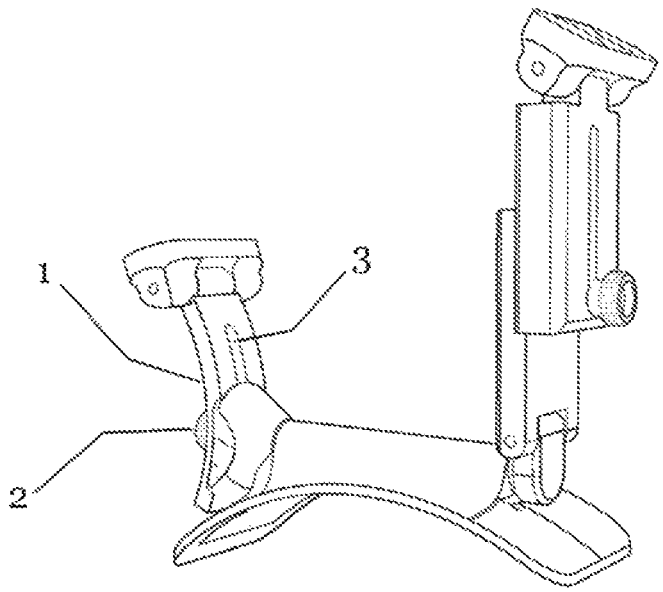
FIG. 11 of the drawings is a perspective embodiment of a support illustrating a second adjustable rigid support member in accordance with this invention.

FIG. 11 of the drawings is a 3 dimensional view of a guitar support implementing an adjustable curved support member (1), an adjustment channel (3), and a securing threaded member (2). The effective length of said adjustable curved support member (1) is adjusted by loosening said securing member (2) and passing it along a machined channel (3) in said curved support member (1). Once a desired placement is achieved a securing member (2) is tightened. Adjusting said curved support member (1) will alter the height of the instrument while in playing position. The methodology for adjusting the length of said curved support member (1) member is similar to adjusting a second adjustable rigid support in FIG. 2 (20).

Figure 12:
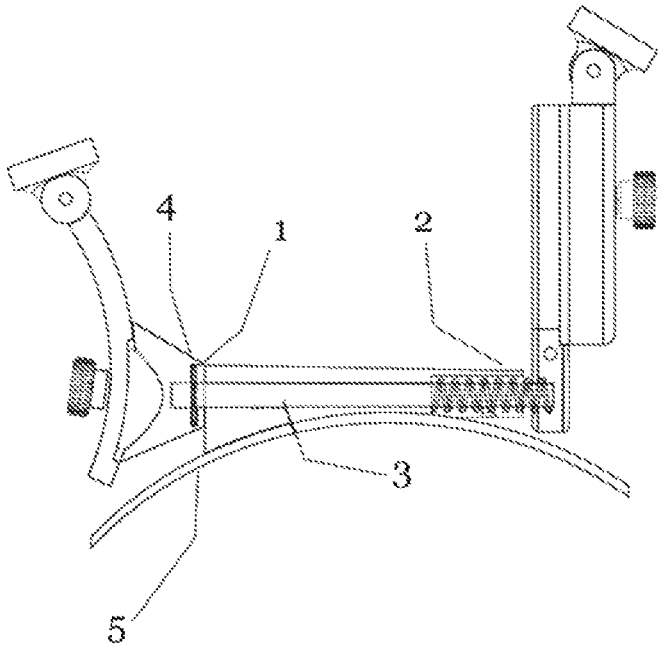
FIG. 12 of the drawings is a perspective embodiment of a support illustrating a rigid leg support member, a toothed clutch mechanism, and a spring-type engaging mechanism for said clutch in accordance with this invention.

FIG. 12 of the drawings is a semi-transparent view of a support implementing a rotating rigid leg support member (5). A first (1) and second (4) toothed securing member, collectively referred to as a toothed clutch, are disengaged by compressing a spring (2). Once a toothed clutch (1, 4) is disengaged a rigid leg support member (5) is free to rotate about an axis member (3). A spring (2) is released to engage a toothed clutch (1, 4) and said rigid leg support member (5) is secured. Rotating a leg support member (5) allows it to rest with maximum contact area on a player's leg thereby increasing comfort.

Figure 13:
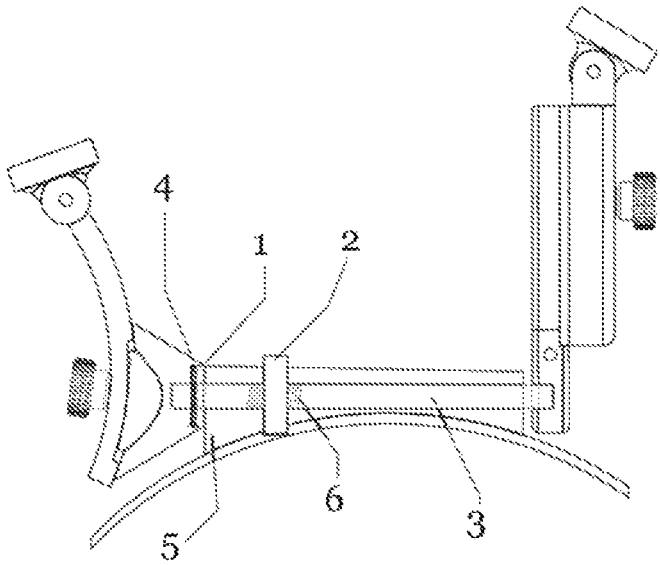
FIG. 13 of the drawings is a perspective embodiment of a support illustrating a rigid support member, a toothed clutch mechanism, and a screw-type engaging mechanism for said clutch in accordance with this invention.

FIG. 13 of the drawings is a semi-transparent view of a support implementing a rotating rigid leg support member (5). A first (1) and second (4) toothed securing member, collectively referred to as a toothed clutch, are disengaged by loosening a female threaded member (2) affixed on a male threaded portion (6) of an axis member (3). Once a toothed clutch (1, 4) is disengaged a rigid leg support member (5) is free to rotate about an axis member (3). A threaded female member (2) is tightened to engage a toothed clutch (1, 4) and said rigid leg support member (5) is secured. Rotating a leg support member (5) allows it to rest with maximum contact area on a player's leg thereby increasing comfort.

Figure 14:
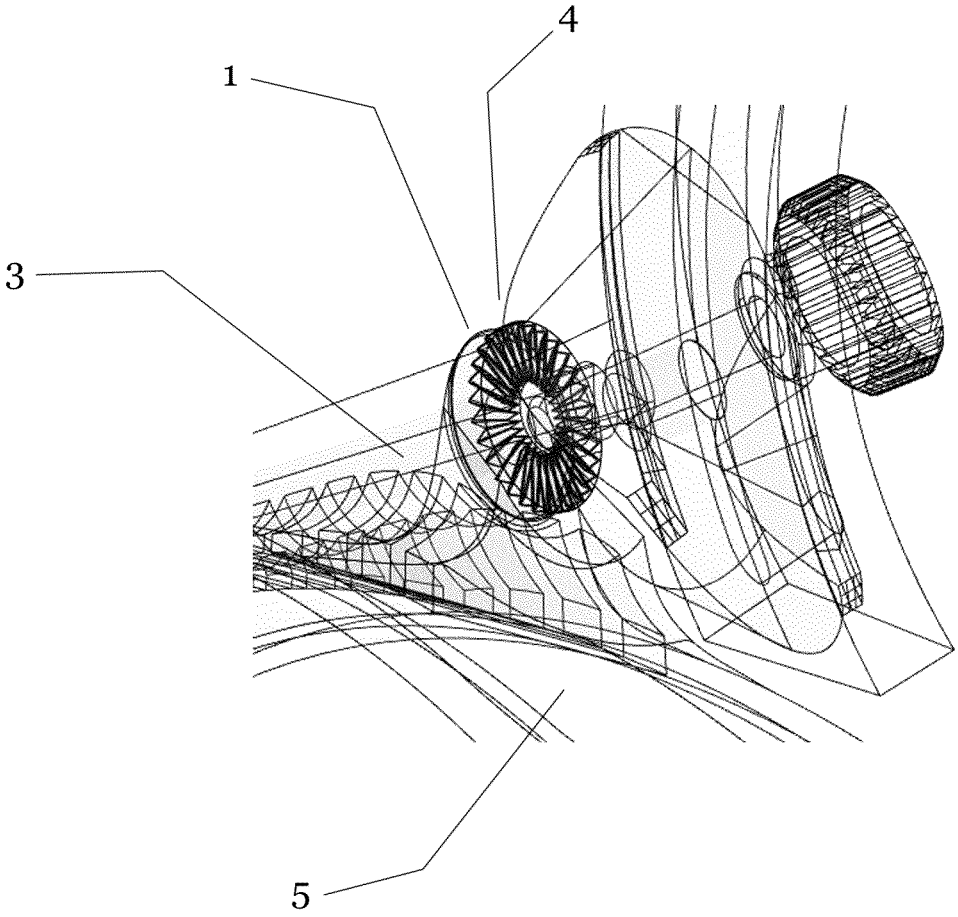
FIG. 14 of the drawings is a semi-transparent detailed view of a toothed clutch mechanism in accordance with this invention.

FIG. 14 of the drawings is a semi-transparent and detailed view of a fully engaged toothed clutch. Once a first (1) and second (4) toothed securing member are disengaged a rigid leg support member (5) is free to rotate about an axis member (3).

Figure 15:
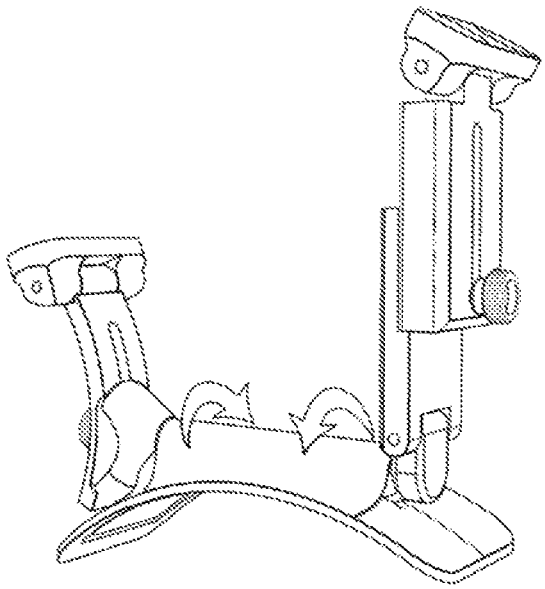
FIG. 15 of the drawings illustrates the rotation of a rigid leg support member about an axis in accordance with this invention.

FIG. 15 of the drawings illustrates a rigid leg support member's direction of rotation about an axis when a toothed clutch is disengaged. Embodiments for engagement mechanisms are not illustrated.

That which is claimed is:

1. A device, for maintaining an orientation of a musical instrument, comprising:

an elongated leg support having a first end and a second end, the elongated leg support comprising a leg support surface extending between the first end and the second end and being configured to maintain contact contours of a human leg during use of the device;

a local magnetic member being connected to the first end of the elongated leg support;

a remote magnetic member being configured to be connected to the musical instrument, and a support member connected to the first end of the elongated leg support and to the local magnetic member;

wherein:

the support member is adjustable in length;

the local magnetic member comprises an instrument support surface; and the local magnetic member is magnetically attracted to the remote magnetic member such that, when the local magnetic member is positioned adjacent the remote magnetic member with the instrument support surface facing the remote magnetic member, the local magnetic member will remain in contact with, and in a static position relative to, the remote magnetic member.

2. The device according to claim 1, wherein the elongated leg support is flexible.

3. The device according to claim 1, wherein the adjustable support member is configured to be secured, selectively in any of a plurality of positions, by a threaded member.

4. The device according to claim 1, further comprising a hinge mechanism connecting the local magnetic member to the elongated leg support.

5. The device according to claim 1, wherein the local magnetic member further comprises a slip-resistant material being a part of, or connected to, the instrument support surface.

6. The device according to claim 2, wherein:

the local magnetic member is a first local magnetic member, the instrument support surface is a first instrument support surface, and the remote magnetic member is a first remote magnetic member;

the device further comprises:

a second local magnetic member being connected to the second end of the elongated leg support; and a second instrument support surface; and a second remote magnetic member being configured to be connected to the musical instrument; and the second local magnetic member is magnetically attracted to the second remote magnetic member when the second local magnetic member is positioned adjacent the second remote magnetic member with the second instrument support surface facing the second remote magnetic member, the second local magnetic member will remain in contact with, and in a static position relative to, the second remote magnetic member.

7. The device according to claim 6, wherein:

the second local magnetic member comprises an adjustment mechanism including a channel and a securing member and being configured for use in adjusting and securing a length of the elongated leg support;

the elongated leg support enters the second local magnetic member through a side of the adjustment mechanism, envelopes the securing member, and exits the second local magnetic member through the side of the adjustment mechanism; and the securing member extends across the channel and secures the elongated leg support against the second local magnetic member.

8. The device according to claim 1, wherein the elongated leg support is rigid.

9. The device according to claim 6, further comprising a second support member being connected to the second end and connecting the elongated leg support to the second local magnetic member.

10. The device according to claim 6, wherein the second support member is adjustable in length.

11. The device according to claim 1, wherein:

the support member is configured and arranged in the device to rotate with respect to the axis member; and the device further comprises a toothed clutch mechanism configured to secure selectively the support member in any of multiple fixed orientations.

12. The device according to claim 6, further comprising a slip-resistant material being a part of, or connected to, an attracting side of the second local magnetic member.

13. The device according to claim 6, wherein:

the second local magnetic member comprises an adjustment mechanism including a channel and a securing member and being configured for use in adjusting and securing a length of the elongated leg support;

the elongated leg support enters the second local magnetic member through a side of the adjustment mechanism, envelopes the securing member, and exits the second local magnetic member through the side of the adjustment mechanism; and the securing member extends across the channel and secures the elongated leg support against the second local magnetic member.

14. A device, for maintaining an orientation of a musical instrument, comprising:

an elongated leg support having a first end and a second end, the elongated leg support further having a leg support surface extending between the first end and the second end and being configured to maintain contact with contours of a human leg during use of the device;

a local magnetic member being connected to the first end of the elongated leg support; and a remote magnetic member being configured to be connected to the musical instrument;

wherein:

the local magnetic member further comprises an instrument support surface;

the local magnetic member further comprises a slip-resistant material being a part of, or connected to, the instrument support surface; and the local magnetic member is magnetically attracted to the remote magnetic member such that, when the local magnetic member is positioned adjacent the remote magnetic member with the instrument support surface facing the remote magnetic member, the local magnetic member will remain in contact with, and in a static position relative to, the remote magnetic member.

15. The device according to claim 14, wherein:

the local magnetic member is a first local magnetic member, the instrument support surface is a first instrument support surface, and the remote magnetic member is a first remote magnetic member;

the device further comprises:

a second local magnetic member being connected to the second end of the elongated leg support;

a second instrument support surface; and a second remote magnetic member being configured to be connected to the musical instrument; and the second local magnetic member is magnetically attracted to the second remote magnetic member when the second local magnetic member is positioned adjacent the second remote magnetic member with the second instrument support surface facing the second remote magnetic member, the second local magnetic member will remain in contact with, and in a static position relative to, the second remote magnetic member.

16. The device according to claim 15, wherein:

the second local magnetic member comprises an adjustment mechanism including a channel and a securing member and being configured for use in adjusting and securing a length of the elongated leg support;

the elongated leg support enters the second local magnetic member through a side of the adjustment mechanism, envelopes the securing member, and exits the second local magnetic member through the side of the adjustment mechanism; and the securing member extends across the channel and secures the elongated leg support against the second local magnetic member.

17. The device according to claim 15, further comprising a slip-resistant material being a part of, or connected to, an attracting side of the said second local magnetic member.

18. The device according to claim 15, wherein the elongated leg support is adjustable in length.

19. The device according to claim 14, wherein the elongated leg support is adjustable in length.

20. A device, for maintaining an orientation of a musical instrument, comprising:

an elongated leg support having a first end and a second end, the elongated leg support including a leg support surface extending between the first end and the second end and being configured to maintain contact with contours of a human leg during use of the device;

a local magnetic member being connected to the first end of the elongated leg support;

a remote magnetic member being configured to be connected to the musical instrument; and a toothed clutch mechanism configured to secure selectively the elongated leg support in any of multiple fixed orientations;

wherein:

the elongated leg support comprises an axis member;

the elongated leg support is configured and arranged in the device to rotate with respect to the axis member;

the local magnetic member further comprises an instrument support surface; and the local magnetic member is magnetically attracted to the remote magnetic member such that, when the local magnetic member is positioned adjacent the remote magnetic member with the instrument support surface facing the remote magnetic member, the local magnetic member will remain in contact with, and in a static position relative to, the remote magnetic member.

21. The device according to claim 20, further comprising a spring mechanism configured and arranged in the device to engage the toothed clutch mechanism thereby securing the toothed clutch mechanism into a position.

22. The device according to claim 20, wherein the axis member has a male threaded portion and an accordant female threaded member configured and arranged in the device to engage the toothed clutch mechanism thereby securing the toothed clutch mechanism into a position.

* * * * *